US005540550A

United States Patent [19]

Kubota

[11] Patent Number: 5,540,550

[45] Date of Patent: Jul. 30, 1996

[54] SOLID IMPELLER FOR CENTRIFUGAL PUMPS

[75] Inventor: Yasushi Kubota, Tokyo, Japan

[73] Assignee: Nikkiso Co., Ltd., Tokyo, Japan

[21] Appl. No.: 346,688

[22] Filed: Nov. 30, 1994

[30] Foreign Application Priority Data

Jan. 21, 1994 [JP] Japan ..... 6-005095
Jan. 21, 1994 [JP] Japan ..... 6-005096

[51] Int. Cl.[6] ..... F04D 29/22

[52] U.S. Cl. ..... 416/179; 416/181; 416/184 R

[58] Field of Search ..... 416/179, 181, 416/182, 185, 186 R, 223 B; 415/90, 206

[56] References Cited

U.S. PATENT DOCUMENTS

| | | | |
|---|---|---|---|
| 885,108 | 4/1908 | Trent | 415/206 |
| 1,865,918 | 7/1932 | Junkers | 416/179 |
| 3,107,625 | 10/1963 | Amberg | 416/186 R |
| 3,647,314 | 3/1972 | Laessig | 415/206 |
| 3,650,636 | 3/1972 | Eskeli | 416/179 |
| 5,180,280 | 1/1993 | Honda | 415/206 |

FOREIGN PATENT DOCUMENTS

| | | | |
|---|---|---|---|
| 234200 | 12/1944 | Switzerland | 416/223 B |
| 25549 | 8/1913 | United Kingdom | 416/186 R |

*Primary Examiner*—James Larson
*Attorney, Agent, or Firm*—Robert D. Schaffer; Rogers & Wells

[57] ABSTRACT

A solid impeller is disclosed having a disk-shaped impeller body having an inlet section extending along the impeller axis of rotation. A plurality of discharge passages extend radially and having inlet and discharge ports. The inlet port has an opening verge face which is oblique to the rotational axis. The solid impeller may also comprise a disk-shaped impeller body having an inlet section extending along the axis of rotation of the impeller and plural discharge passages extending radially. It further has inlet and discharge ports which have a tapered shape so that the section area of the discharge passage is gradually reduced in the outward direction. The thickness of the body is also gradually reduced in the outward direction. The solid impeller may also comprise a cylindrically-shaped center body and plural arms on a peripheral surface of the body. These extend radially in an outward direction from the body and include a discharge passage which extends along a longitudinal direction of the arm.

4 Claims, 14 Drawing Sheets

SOLID IMPELLER FOR CENTRIFUGAL PUMPS

BACKGROUND OF THE INVENTION

This invention relates to an impeller for centrifugal pumps, and more particularly to an improved solid impeller for a low specific speed pump having low flow and a high pump head.

It has been known in the art that a solid impeller is useful in a low specific speed pump to prevent lowering of pump efficiency which is caused by relative circulation of the treating liquid within the impeller flow passage. In FIGS. 1 and 2, a solid impeller 10 is shown, which comprises a disk-shaped body 14 having an inlet portion 12 at its center on one side thereof and a plurality of discharge passages 20 radially extending from the center portion to a peripheral region of the body. The discharge passage 20 has an inlet port 16 at one end and a discharge port 18 at its opposite end. Unlike the normal impeller, the solid impeller for a low specific speed pump has its impeller flow passage comprising a flow passage 20 for suppressing the relative circulation of the treating liquid to thereby prevent lowering of the pump efficiency.

The above radial discharge passages 20, however, cause the following disadvantages. For the radial discharge passage 20, it is required that a fluid inlet angle alpha defined by an inlet direction and a discharge direction of the treating liquid is normally set at a relatively large angle, for example, 90°. The inlet port area S is set relatively small. Under the above circumstances, a variation of the actual fluid inlet angle of the treating liquid at the inlet port 16 is unavoidable. The variation of the fluid inlet angle of the treating liquid may cause an increase in a contraction effect. The increase of the contraction effect may cause suction inefficiency of the impeller discharge passage. This may result in a lowering of the pump efficiency and a generation of cavitation. Those problems are more serious when operating at a low specific speed.

To solve the above problem, another solid impeller has been proposed and is disclosed in the Japanese Utility Model Publication No. 57-45427. The other solid impeller is illustrated in FIGS. 3 and 4. A solid impeller 22 comprises a disk-shaped body 14 having an inlet portion 12 at its center portion on one side thereof and a plurality of discharge passages 20 radially extending from the center portion to a peripheral region of the body. The discharge passage 20 has an inlet port 16 at its one end and a discharge port 18 at its opposite end. Further, at the inlet port 16, an enlarged chamber 24 is provided to expand the diameter of the discharge passage 20. This is so that auxiliary inlet blades 26 are provided in the enlarged chamber 24. The blades 26 extend from a peripheral wall of the enlarged chamber 24 toward a center of the body to separate individual inlet ports 16. This is for a rectification of the fluid inlet of the treating liquid at the inlet port 16. The rectification effect of the fluid inlet may suppress both the variation of the fluid inlet angle of the treating liquid and the increase of the contraction effect caused by the variation of the fluid inlet angle. As a result, the suction of the discharge passage 20 is improved thereby lowering the pump efficiency. Cavitation may also be suppressed.

This solution, however, has other problems as described below. The other solid impeller has the enlarged chamber 24 having the auxiliary inlet blades 26 for improving the suction of the inlet port 16 of the discharge passage 20.

Additional processes are required for preparing the plural auxiliary inlet blades 26, in particular welding of a back of the inlet blade 26. This requires complicated fabrication processes that may result in a high manufacturing cost of the solid impeller.

Alternatively, as illustrated in FIGS. 5 and 6, each of the discharge passages 20 may comprise a straight passage radially extending from the center of the body to the peripheral region thereof. The discharge passage 20 has the inlet port 16 and the discharge port 18, both of which are the same size in width and height.

The solid impeller 10 comprises the straight discharge passage 20. By having a straight discharge, relative circulation of the treating liquid in the discharge passage 20 may be suppressed. This may occur in a low specific speed pump. Also, a decrease in the pump efficiency which may be caused by the relative circulation may also be suppressed.

Notwithstanding, the above solid impeller having the straight discharge passage 20 has the following disadvantages. In the above solid impeller, the passage for the treating liquid comprises only the straight discharge passage 20. This is to suppress the relative circulation of the treating liquid in the discharge passage 20 and thereby any lowering of the pump efficiency is prevented. On the other hand, a disk friction loss due to the impeller itself or a lowering of the pump efficiency is unavoidable. The disk friction loss Pd is given by the following equation:

$$Pd=K_1\ r\ u^3\ D\ (D+5B_2) \tag{1}$$

where $K_1$ is the coefficient, r is the specific weight of liquid ($Kg/cm^3$), u is the peripheral speed (m/s), D is the outer diameter of impeller (m) and $B_2=h_2=2t$: the thickness of the impeller body at its peripheral part. The coefficient $K_1$, the specific weight r, the peripheral speed u, and the outer diameter D are defined by the specific speed. The thickness $B_2$ is optionally set to match the various conditions.

In the above conventional solid impeller, as illustrated in FIGS. 5 and 6, the discharge passage 20 is formed to have the same sizes both between w1 and w2 and between h1 and h2. This requires the thickness $B_2$ to be set at a relatively large thickness. If the thickness $B_2$ is set at a small value, the height $h_2$, the height $h_1$, and the width $w_1$ are small thereby resulting in a decrease in suction. As a result, the disk friction loss (Pd) achieves a considerably large value. The friction loss is increased by increasing the outer diameter D of the disk or by lowering the specific speed.

Consequently, the conventional solid impeller may prevent the relative circulation loss of the treating liquid. However, it still may have a problem due to generating disk friction loss of the impeller body. Therefore, a substantial improvement in the pump efficiency is not achieved.

In the general view of the design of the impeller for the centrifugal pump, the specific speed $n_s=n\ Q^{0.5}/H^{0.75}$ is very important, where the flow is $Q(m^3)$, the pump head is H(m), and the rotation speed is n(r.p.m.). In the normal specific speed, for example, not less than 100, a shroud impeller 11 having a shroud **11*a* is available as illustrated in FIG. 7. In a lower specific speed than 100, an open impeller 21 comprising a radiation blade 21*a* is available as illustrated in FIG. 8. Alternatively, the solid impeller 10 comprising the disk-shaped body 14 including a plurality of passages 20 provided radially as illustrated in FIGS. 9 and 10** is also available.

In the shroud impeller 11 of FIG. 7, an outer diameter is made large to match the low specific speed. In this case, the friction loss or the disk friction loss due to the shroud **11*a*** is rapidly increased and is proportional to five times the outer diameter. This results in a considerable lowering of the pump efficiency. From the above, it is found that the shroud impeller is unsuitable when using a low specific speed.

In the open impeller of FIG. 8, even if the outer diameter of the impeller is made large, almost no increase of the disk friction loss appears. This is due to elimination of the shroud. Notwithstanding, when having a lower specific speed, a circulation flow loss due to vortex flows 23 within the passage is generated. This results in a considerable lowering of the pump efficiency. From the above, it is found that an open impeller is not available when using very low specific speeds.

By contrast, the solid impeller 10 having the straight discharge passages 20 may prevent any generation of circulation loss over the entire range of the specific speed, particularly in very low specific speeds. For that reason, the solid impeller has been widely used, particularly for the low specific speed pump.

Such a solid impeller, however, has the following problems. In the solid impeller 10, an axial thrust $T=A(P_d-P_s)$ is generated having a suction pressure $P_s$ ($Kg/m^2$), a discharge pressure $P_d$ ($Kg/m^2$), and a pressure area A ($m^2$). The axial thrust (T) of the solid impeller is considerably large due to a large pressure area (A). The axial thrust (T) is increased by reduction of the low specific speed. To suppress the generation of the axial thrust, it is required to provide the impeller body 14 with an extra rear fixed orifice 14*c* and a balance hole 14*d* having a considerably large diameter. Such a solid impeller has a complicated structure and a heavy weight. This results in both an imbalance of the axial thrust and in a generation of a leakage loss 25. The fixed orifice 14*c* also has bearing problems. Therefore, the reliability of pump operations is decreased. The balance hole 14*d* also permits bypass of the treating liquid and therefore the pump efficiency is lowered. By contrast, the open impeller 21 having the small pressure area A, as illustrated in FIG. 8, may prevent both lowering of the reliability of the pump operation and lowering the pump efficiency.

In the solid impeller 10, the body 14 has a united structure. In this way, the disk friction loss is considerably large, although the shroud impeller 11 of FIG. 7 shows a larger disk friction loss. The amount of the friction loss of the solid impeller is further increased by the increase of the diameter of the impeller and the decrease of the specific speed. This results in a considerable decrease of the pump efficiency. The open impeller 21 having the radiation blades 21*a* is free from a lowering of the pump efficiency.

Under a low specific speed condition, the open impeller has the problem of a decrease in the pump efficiency due to the circulation loss. The solid impeller also has problems in lowering the reliability of both the pump operation and pump efficiency due to the axial thrust, leakage loss, and impeller friction loss.

SUMMARY OF THE INVENTION

Accordingly, it is a primary object of the present invention to provide a novel solid impeller with such a simple structure as to permit improvement in the suction of an inlet port.

It is a further object of the present invention to provide a novel solid impeller which is capable of both preventing the generation of relative circulation loss of a treating liquid and reducing the disk friction loss of an impeller body.

It is a still further object of the present invention to provide a novel solid impeller which is usable in a low specific speed and which is also capable of both preventing various losses such as circulation loss, leakage loss, and disk friction loss, and controlling an axial thrust to improve the reliability of pump operation and the pump efficiency.

The above and other objects, features and advantages of the present invention will be apparent from the following descriptions.

The invention provides a novel solid impeller comprising a disk-shaped impeller body provided at its center portion with an inlet section extending along an axis of rotation of the solid impeller and a plurality of discharge passages extending in radial-outward directions. Each of the discharge passages has an inlet port at a boundary to the inlet section and a discharge port at a peripheral region of the disk-shaped impeller body. The inlet port of the discharge passage has an opening verge face which is oblique to the rotation axis.

It is preferable that an opening verge of the inlet port also comprises a chamfered edge having curvatures.

It is also preferable that the opening verge of the inlet port comprises a step-like shaped opening verge.

It is also preferable to provide a balance hole at the opening verge of the inlet port.

The invention also provides a novel solid impeller comprising a disk-shaped impeller body provided at its center portion with an inlet section extending along an axis of rotation of the solid impeller and a plurality of discharge passages extending in radial-outward directions. Each of the discharge passages has an inlet port at a boundary to the inlet section and a discharge port at a peripheral region of the disk-shaped impeller body. Each of the discharge passages has a tapered shape in the outward direction so that a section of the area of the discharge passage is gradually reduced in the outward direction. A thickness of the disk-shaped impeller body is also gradually reduced in the outward direction.

In this case, it is preferable that the width in a horizontal direction of the discharge passage is gradually reduced in the outward direction.

It is also provided that the discharge passage has a front side wall at a front side in a rotational direction of the impeller body and a rear side wall at a rear side in the rotational direction of the impeller body. The front side wall is oblique to a diametrical direction of the disk-shaped impeller body and the rear side wall is parallel to the diametrical direction of the disk-shaped impeller body. This is so that at least a longitudinal center axis of the discharge passage is oblique to the diametrical direction of the impeller body and so that the horizontal width of the discharge passage is gradually reduced in the outward direction.

It is further provided that the longitudinal center axis of the discharge passage is parallel to the diametrical direction.

The invention also provides a novel solid impeller comprising a cylindrically-shaped center body and a plurality of arms provided on a peripheral surface of the center body. This is to radially extend in an outward direction from the center body. Each of the arms includes a discharge passage extending along a longitudinal direction of the arm.

It is preferable that the discharge passage has a discharge port having an opening verge face which is vertical to a diametrical direction of the impeller.

According to the present invention, neither a fixed orifice nor a balance hole is needed to control the axial thrust of the impeller.

As described above, the inlet port of each of the discharge passages of the solid impeller of the present invention has an opening verge face which is oblique to the rotational axis where the inlet flow of the treating liquid in the inlet section has substantially the same direction as the rotational axis. The opening verge of the inlet port may comprise either a chamfered edge with curvatures or a step-like shaped opening verge. The oblique opening verge face of the inlet port may provide an enlargement of an opening area of the inlet port verge and also may provide a reduction of the fluid inlet angle. It may also provide a variation in the flow direction of the treating liquid at the boundary between the inlet section and the inlet port of each of the discharge passages. This may result in less reduction of an inflow rate of the treating liquid as it enters the discharge passage. It may also suppress the contraction effect. This permits an improvement in the inlet capacity of the inlet port of each of the discharge passages. The improved inlet property or the improved inlet capacity may improve the pump efficiency and may also suppress any cavitation.

According to the present invention, each of the discharge passages has a tapered shape in the outward direction so that a section area of each of the discharge passages is gradually reduced in the outward direction. Further, the disk-shaped impeller body has a variable thickness which is gradually reduced in the outward direction. Those structures may suppress any relative circulation of the treating liquid in the impeller and also may permit a reduction of the disk friction loss of the impeller body. The above structures of the impeller may further permit variable design choices of the sizes of the inlet port of the discharge passage. For example, a variation in an opening verge area of the inlet port may occur by changing an angle of the opening verge face of the inlet port to the rotational axis of the impeller where the flow direction of the treating liquid in the inlet section is parallel to the rotational axis. This may permit a further improvement in the inflow property of the treating liquid when it enters the discharge passage.

According to the present invention, the impeller comprises a cylindrically-shaped center body and a plurality of arms provided on a peripheral surface of the center body to radially extend in an outward direction from the center body. Each of the arms has a discharge passage extending along a longitudinal direction of the arm so that any flow passages involved in the impeller comprise cylindrically-defined passages. This is to prevent a circulation flow loss which would be due to a circulating flow of the treating liquid. The peripheral section of the impeller comprises the arms which include the radially extending discharge passages in the outward direction. This is so that a pressure receiving area of the impeller is extremely small. This facilitates control of the axial thrust and further prevents leakage losses and reduces friction of the impeller as well as suppresses disk friction loss.

BRIEF DESCRIPTIONS OF THE DRAWINGS

Preferred embodiments of the present invention will hereinafter be fully described in detail with reference to the accompanying drawings.

DESCRIPTIONS OF THE INVENTION

Figure 11:
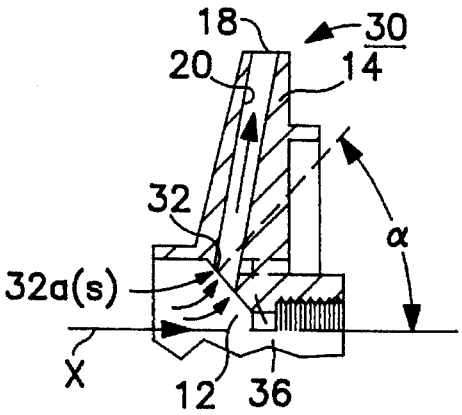
FIG. 11 is a fragmentary cross-sectional elevation view illustrative of a novel solid impeller in a first embodiment according to the present invention.

A first embodiment according to the present invention will be described with reference to FIGS. 11 and 12 that illustrate a novel structure of a solid impeller. A novel solid impeller 30 of this embodiment according to the present invention comprises a disk-shaped impeller body 14 provided at its center portion with an inlet section 12 extending along an axis X of rotation of the solid impeller 30 and a plurality of discharge passages 20 extending in radial-outward directions. Each of the discharge passages 20 has an inlet port 32 at a boundary to the inlet section and a discharge port 18 at a peripheral region of the disk-shaped impeller body. The inlet port 32 of the discharge passage has an opening verge face 32*a* oblique to the rotation axis X.

The discharge flow passage comprises a single straight passage only to prevent relative circulation of a treating liquid in the discharge passage 20. This results in an improvement in the pump efficiency.

As described above, the inlet port 32 of each of the discharge passages 20 of the solid impeller 30 has an opening verge face 32*a* oblique to the rotation axis X of the solid impeller 30. The inlet flow of the treating liquid in the inlet section 12 has substantially the same direction as the rotational axis X. The oblique opening verge 32*a* of the inlet port 32 of the discharge passage 20 has an elliptical shape. This may provide an enlargement of an opening area S of the inlet port verge 32*a*. Further, the oblique opening verge 32*a* of the inlet port 32 of the discharge passage 20 may provide a reduction of a fluid inlet angle "alpha" or of a variation in the flow direction of the treating liquid at the boundary between the inlet section 12 and the inlet port 32 of each of the discharge passages 20. This results in almost no reduction of an inflow rate of the treating liquid entering the discharge passages 20. Having almost no reduction of the inflow rate of the treating liquid may result in a suppression of a contraction effect. It may permit an improvement in suction or suction capacity of the inlet port 32 of each of the discharge passages 20. The improved suction or suction capacity may also improve the pump efficiency and may suppress any cavitation.

The inlet port 32 of the discharge passage 20 has not only the above described oblique opening verge 32*a* but also a truncated cone-like wall 34 that faces obliquely to the rotational axis X. The oblique opening verge face 32*a* is included in the truncated cone-like wall 34. Such a truncated cone-like wall 34 may serve as an auxiliary suction blade of the truncated cone-like shape so that the improved solid impeller has the above described advantages.

Figure 13:
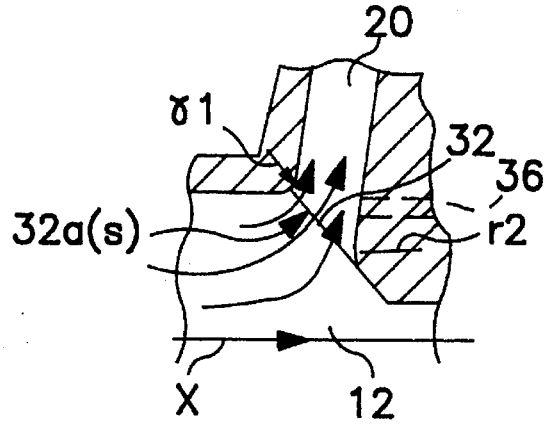
FIG. 13 is a fragmentary enlarged cross-sectional elevation view of the impeller of FIG. 11.

It is preferable that the opening verge 32*a* of the inlet port 32 of the discharge passage 20 comprises a chamfered edge having curvatures r1 and r2 as illustrated in FIG. 13.

Figure 12:
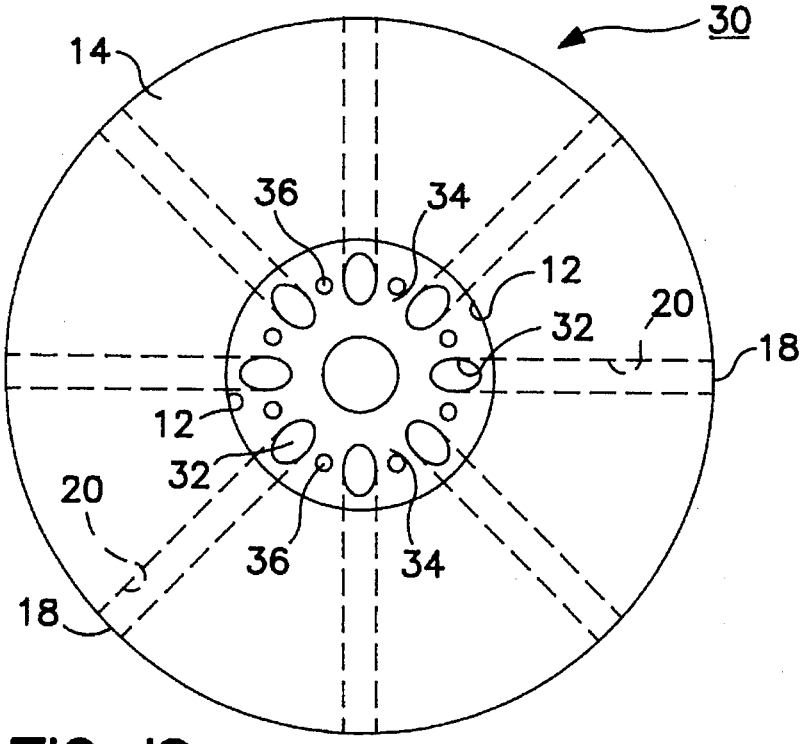
FIG. 12 is a plan view illustrative of the impeller of FIG. 11.

It is also preferable to provide a plurality of balance holes 36 on the truncated cone-like wall 34 which serves as auxiliary suction blades between individuals of the opening verge of the inlet port 32 as illustrated in FIGS. 12 and 13.

Figure 1:
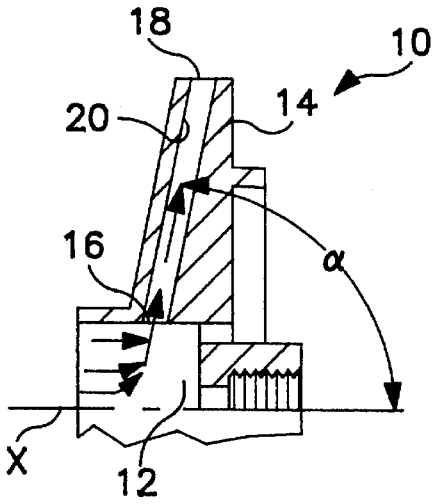
FIG. 1 (PRIOR ART)
FIG. 1 is a fragmentary cross-sectional elevation view illustrative of the conventional solid impeller.
Figure 2:
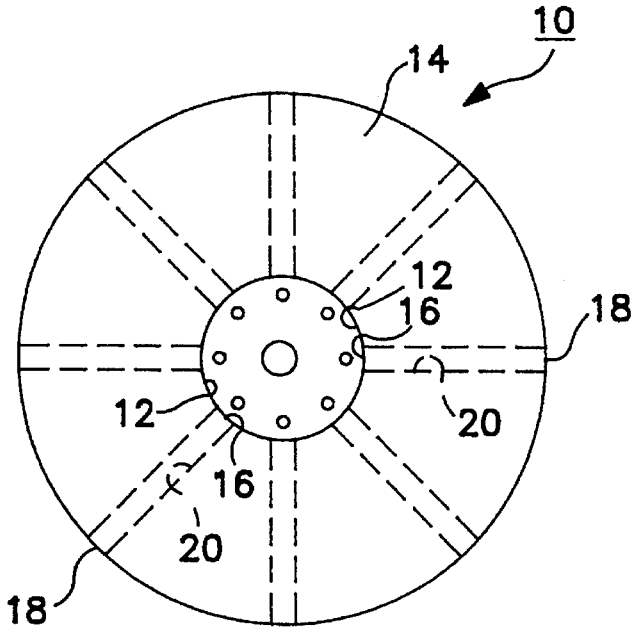
FIG. 2 (PRIOR ART)
FIG. 2 is a plan view illustrative of the conventional solid impeller of FIG. 1.
Figure 3:
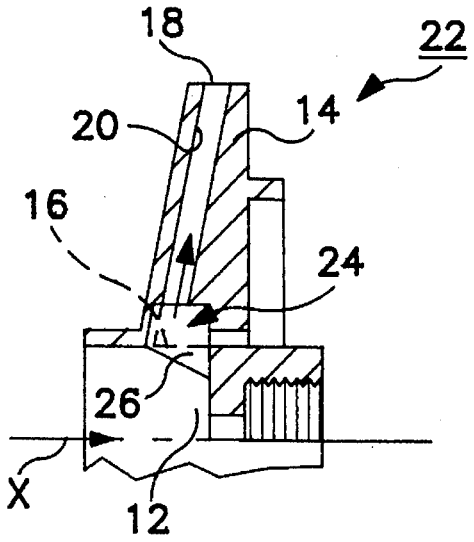
FIG. 3 (PRIOR ART)
FIG. 3 is a fragmentary cross-sectional elevation view illustrative of another conventional solid impeller.
Figure 4:
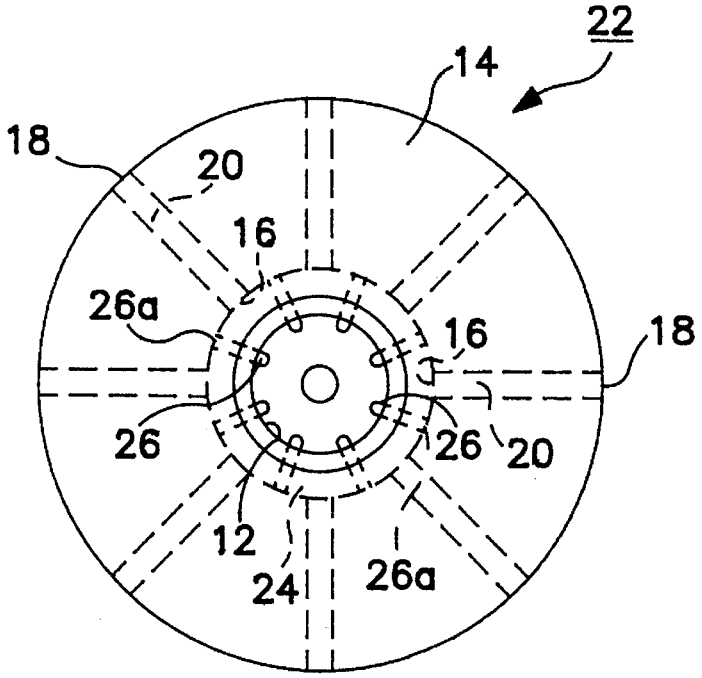
FIG. 4 (PRIOR ART)
FIG. 4 is a plan view illustrative of the impeller of FIG. 3.
Figure 5:
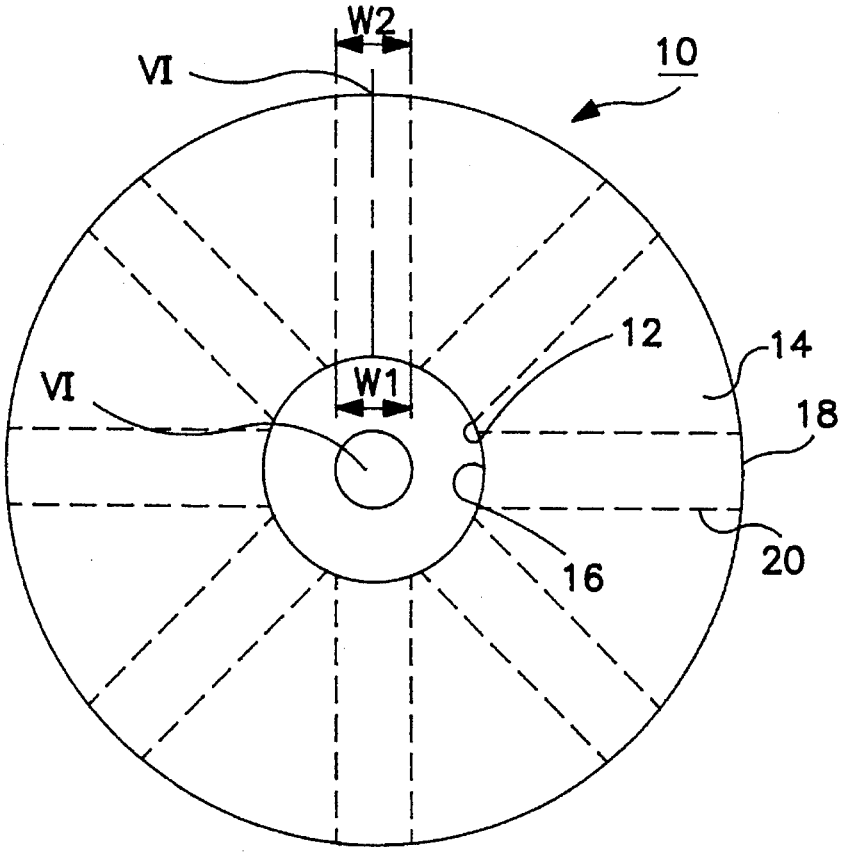
FIG. 5 is a plan view illustrative of another conventional solid impeller.
Figure 6:
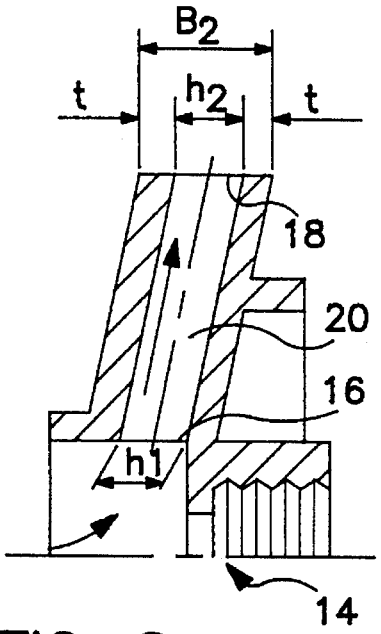
FIG. 6 is a fragmentary cross-sectional elevation view illustrative of the impeller of FIG. 5.
Figure 7:
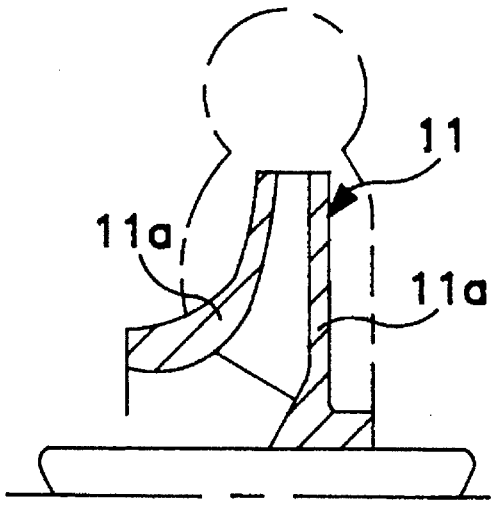
FIG. 7 (PRIOR ART)
FIG. 7 is a fragmentary cross-sectional elevation view illustrative of a normal shroud impeller.
Figure 8:
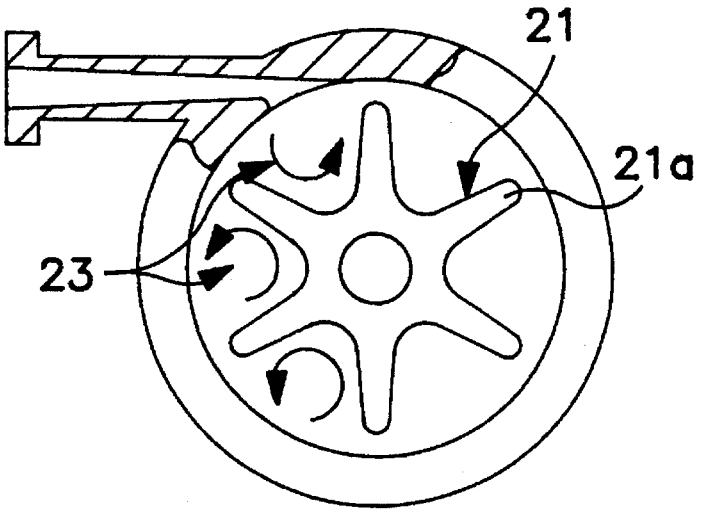
FIG. 8 (PRIOR ART)
FIG. 8 is a plan view illustrative of a normal open impeller.
Figure 9:
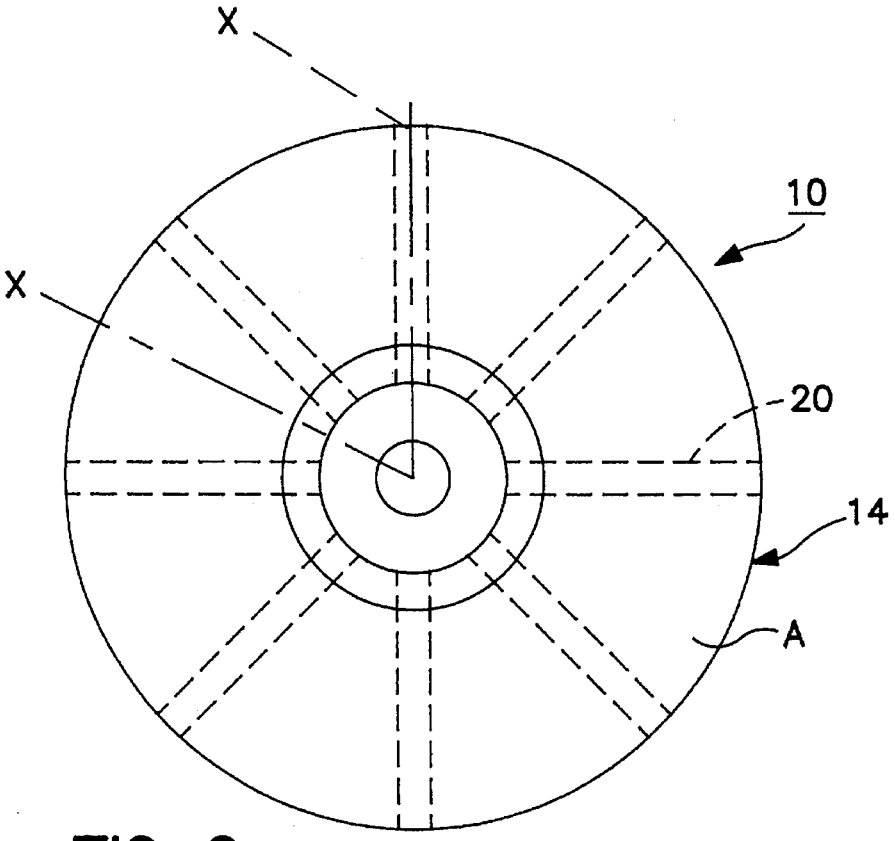
FIG. 9 (PRIOR ART)
FIG. 9 is a plan view illustrative of another conventional solid impeller.
Figure 10:
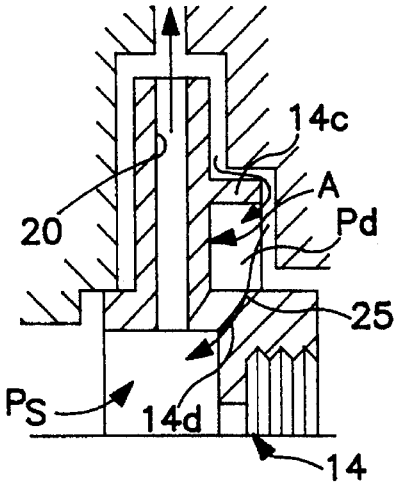
FIG. 10 (PRIOR ART)
FIG. 10 is a fragmentary cross-sectional elevation view illustrative of the impeller of FIG. 9.

The advantages as described above are appreciated from the measurement results of suction properties and performances of the improved solid impeller of the first embodiment and the conventional solid impeller of FIGS. 1 and 2.

Figure 14:
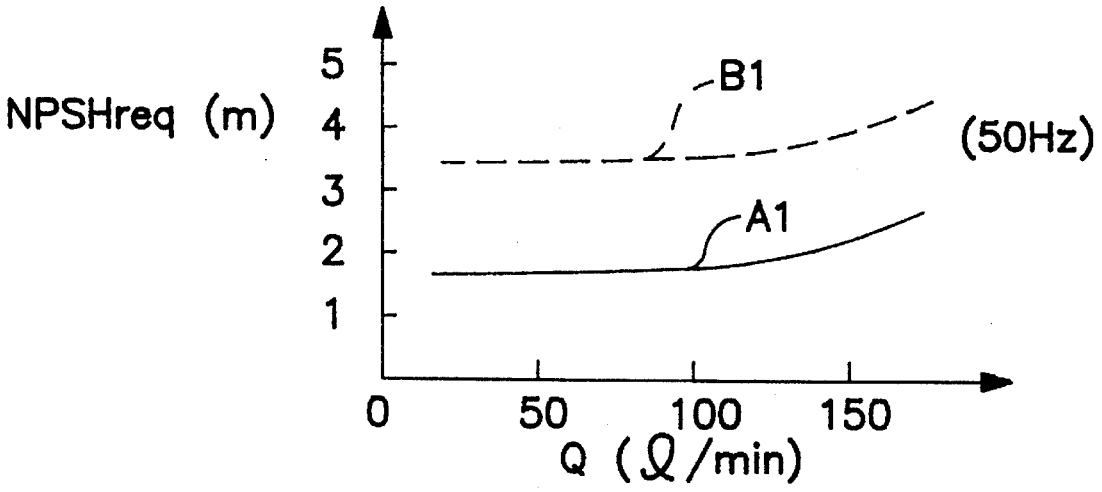
FIG. 14 is a graph of section properties of the impeller of FIG. 11 and of a conventional solid impeller.

FIG. 14 illustrates the measurement results of the suction properties (NPSHreq) in the low flow rate range of from 0 (l/min) to 150 (l/min). The real line A1 represents the measurement values of the suction properties of the improved solid impeller of the first embodiment, while the broken line B1 represents the measurement values of the suction properties of the conventional solid impeller. The suction property represented by the real line A1 of the improved solid impeller is considerably improved as compared to the suction property represented by the broken line B1 of the conventional solid impeller.

Figure 15:
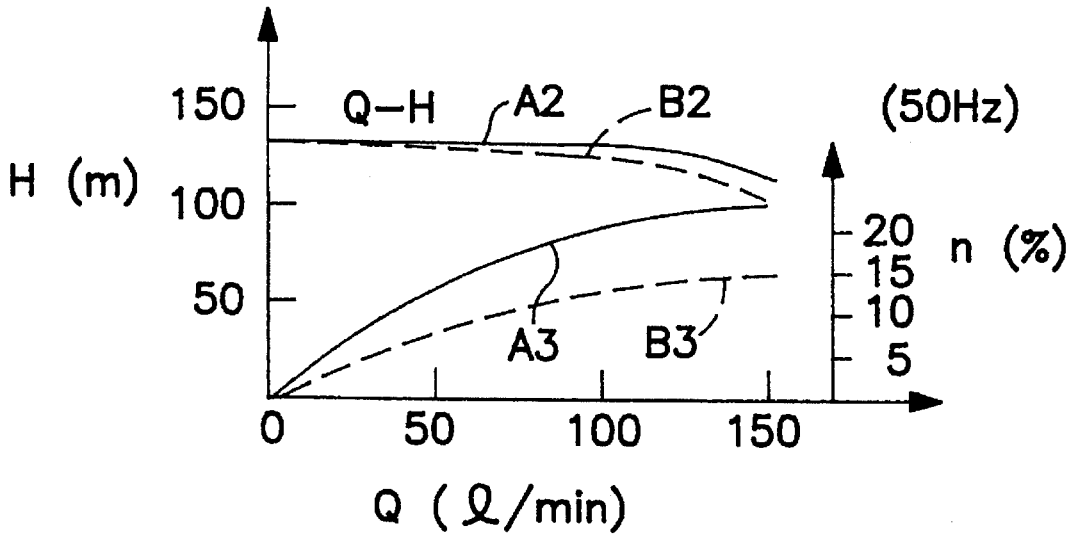
FIG. 15 is a graph of performances of the impeller of FIG. 11 and of a conventional solid impeller.

FIG. 15 illustrates the measurement results of the pump performances (Q–H and η) in the low flow rate range of from 0 (l/min) to 150 (l/min). The real lines A2 and A3 represent the measurement values of the pump performances of the improved solid impeller of the first embodiment, while the broken lines B2 and B3 represent the measurement values of the pump performances of the conventional solid impeller. The pump performances represented by the real lines A2 and A3 of the improved solid impeller are also considerably improved as compared to the pump performances represented by the broken lines B2 and B3 of the conventional solid impeller.

From the above, the improved solid impeller of the first embodiment according to the present invention has the improved suction property as illustrated in FIG. 14 thereby resulting in an improvement in pump efficiency and in almost no cavitation. The improved solid impeller of the first embodiment according to the present invention has a relatively simple structure as illustrated in FIGS. 11 and 12. This may permit the improved solid impeller to be free from any complicated fabrication processes and from a costly manufacturing process.

A second embodiment according to the present invention will be described with reference to FIGS. 16 and 17 that illustrate a novel structure of the solid impeller. A novel solid impeller 40 of this embodiment has a structural difference in an inlet port 42 of each of discharge passages 20 involved in the impeller 40. The inlet port 42 has an opening verge 42*a* of step-like shape. The novel solid impeller 40 comprises a disk-shaped impeller body 14 provided at its center portion with an inlet section 12 extending along an axis X of rotation of the solid impeller 40 and a plurality of discharge passages 20 extending in radial-outward directions. Each of the discharge passages 20 has an inlet port 42 at a boundary to the inlet section and a discharge port 18 at a peripheral region of the disk-shaped impeller body. The inlet port 42 of the discharge passage has an opening verge with such a step-like shape that an opening verge face of the step-like shaped opening verge 42*a* of the inlet port 42 faces obliquely to the rotational axis X.

The discharge flow passage comprises a single straight passage only to prevent any relative circulation of a treating liquid in the discharge passage 20. This results in an improvement in the pump efficiency.

As described above, the inlet port 42 of each of the discharge passages 20 involved in the solid impeller 40 has the step-like shaped opening verge 42*a* whose face is oriented obliquely to the rotational axis X of the solid impeller 40. The inlet flow of the treating liquid in the inlet section 12 has substantially the same direction as the rotational axis X. The oblique step-like shaped opening verge 42*a* of the inlet port 42 of the discharge passage 20 has an elliptical shape in a plan view. This may provide an enlargement of an opening area S of the step-like shaped inlet port verge 42*a*. Further, the oblique step-like shaped opening verge 42*a* of the inlet port 42 of the discharge passage 20 may provide a reduction of a fluid inlet angle "alpha" or of a variation in a flow direction of the treating liquid at the boundary between the inlet section 12 and the inlet port 42 of each of the discharge passages 20. This results in almost no reduction of an inflow rate of the treating liquid entering the discharge passage 20. Such reduction of the inflow rate of the treating liquid may result in a suppression of contraction. It may further permit an improvement in a suction property or a suction capacity of the inlet port 42 of each of the discharge passages 20. The improved suction property or the improved suction capacity may improve the pump efficiency and may also suppress any generation of cavitation.

The inlet port 42 of the discharge passage 20 has not only the above described step-like shaped oblique opening verge 42*a* but also a truncated cone-like wall 44 that faces obliquely to the rotational axis X. The step-like shaped oblique opening verge face 42*a* is included in the truncated cone-like wall 44. Such a truncated cone-like wall 44 may serve as an auxiliary suction blade of the truncated cone-like shape so that the improved solid impeller has the above described advantages.

Figure 16:
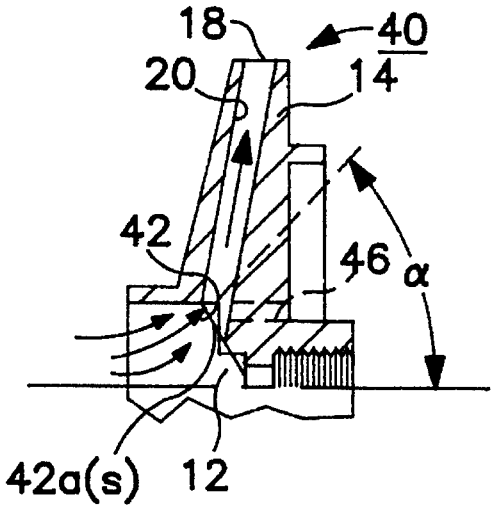
FIG. 16 is a fragmentary cross-sectional elevation view illustrative of a novel solid impeller in a second embodiment according to the present invention.
Figure 17:
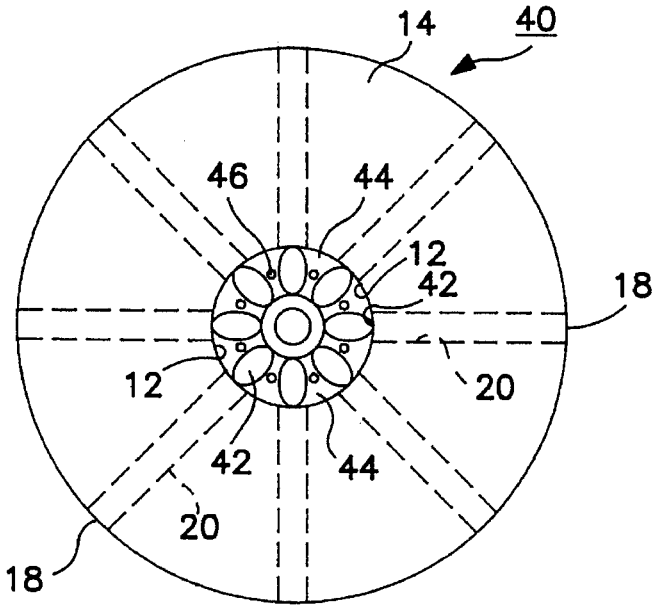
FIG. 17 is a plan view illustrative of the impeller of FIG. 16.

It is preferable to provide a plurality of balance holes 46 on the truncated cone-like wall 44 which serves as auxiliary suction blades between individuals of the opening verge of the inlet port 42 as illustrated in FIGS. 16 and 17.

The advantages as described above are appreciated from the measurement results of suction properties and performances of the improved solid impeller of the first embodiment and the conventional solid impeller of FIGS. 1 and 2.

Figure 18:
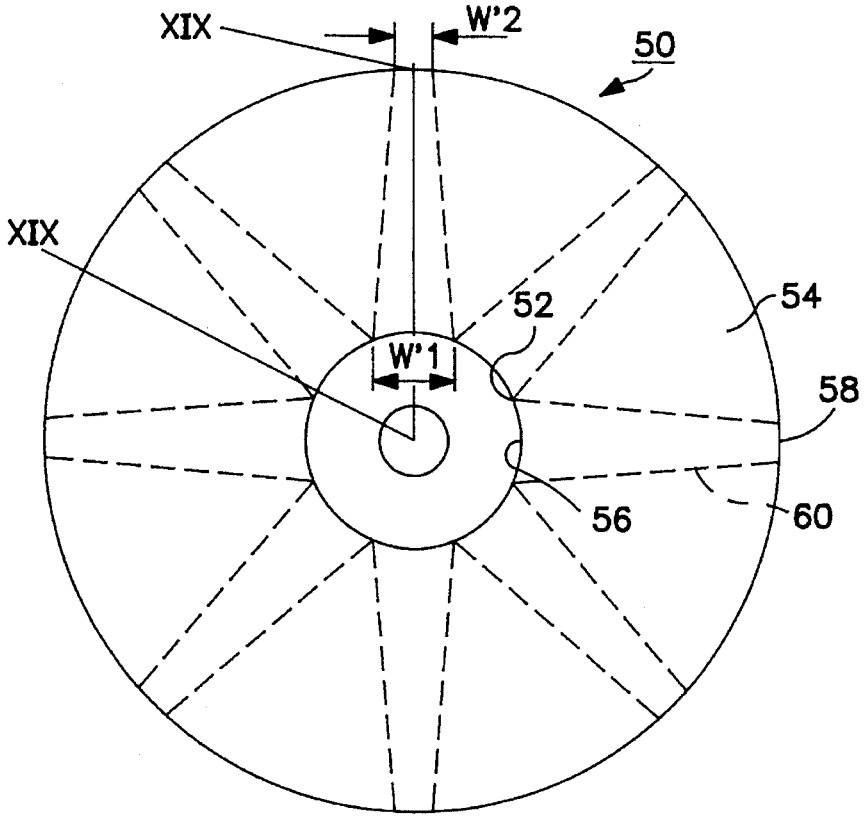
FIG. 18 is a plan view illustrative of a novel solid impeller in a third embodiment according to the present invention.
Figure 19:
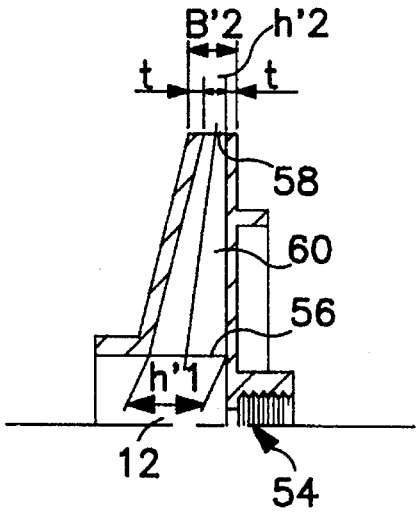
FIG. 19 is a fragmentary cross-sectional elevation view illustrative of the impeller of FIG. 18.

A third embodiment according to the present invention will be described with reference to FIGS. 18 and 19 that illustrate a novel structure of the solid impeller. A novel solid impeller 50 of this embodiment according to the present invention has a structural difference in discharge passages 60 involved in the impeller 50. The novel solid impeller 50 comprises a disk-shaped impeller body 54 provided at its center portion with an inlet section 12 extending along an axis X of rotation of the solid impeller 50 and a plurality of discharge passages 60 extending in radial-outward directions. Each of the discharge passages 60 has an inlet port 56 at a boundary to the inlet section and a discharge port 58 at a peripheral region of the disk-shaped impeller body. The inlet port 56 of the discharge passage 60 has an opening verge face parallel to the rotation axis X. Each of the discharge passages 60 has a tapered shape in the outward direction so that a section area of the discharge passage 60 is gradually reduced in the outward direction. A thickness B of the disk-shaped impeller body 54 is also gradually reduced in the outward direction. The thickness of the disk-shaped impeller body 54 is proportionally reduced outwardly between the inlet port 56 and the outlet port 58. Similarly, the height h of the individual discharge passage 60 is also proportionally reduced outwardly from $h'_1$ at the inlet port 56 to $h'_2$ at the outlet port 58. Further, as illustrated in FIG. 18, the width W of the individual discharge passage 60 is also proportionally reduced outwardly from $W'_1$ at the inlet port 56 to $W'_2$ at the outlet port 58.

It is preferable that the section sizes of the discharge passage 60 are set so that the width $w'_1$ is the same as the height $h'_1$ as well as the width $w'_2$ is the same as the height $h'_2$ to permit the discharge passage 60 to have a square sectioned shape. It is further preferable that the width $W'_1$ is set at the maximum permissible size of the inlet port 56. Needless to say, the sectioned size or section area of the discharge passage 60 has to be reduced to permit a smooth increase of a speed of the treating liquid flowing in the discharge passage 60 without generating circulation of the treating liquid.

The disk-shaped impeller body 54 of the improved solid impeller 60 is so defined that the thickness $B'_2$ at the peripheral region of the impeller body 54 is sufficiently smaller than the thickness of the impeller body 54 where the inlet port 56 is provided, thereby resulting in a sufficient reduction of an area of the peripheral side face of the impeller body 54. Such a reduction of the peripheral side face area of the impeller body 54 may provide a considerable reduction of disk friction loss (Pd). This may result in a considerable improvement in the pump efficiency. As described above, the improved solid impeller 50 has a sufficiently large area of an opening vergae of the inlet port 56 of the discharge passage 60. Securing the large area of the opening vergae of the inlet port 56 may ensure a sufficient high suction property for the solid impeller.

Moreover, the reduction outwardly in the thickness of the disk-shaped impeller body 54 may provide an advantage in a relatively light weight of the solid impeller thereby resulting in a facilitation of precision casting of the impeller body.

Figure 20:
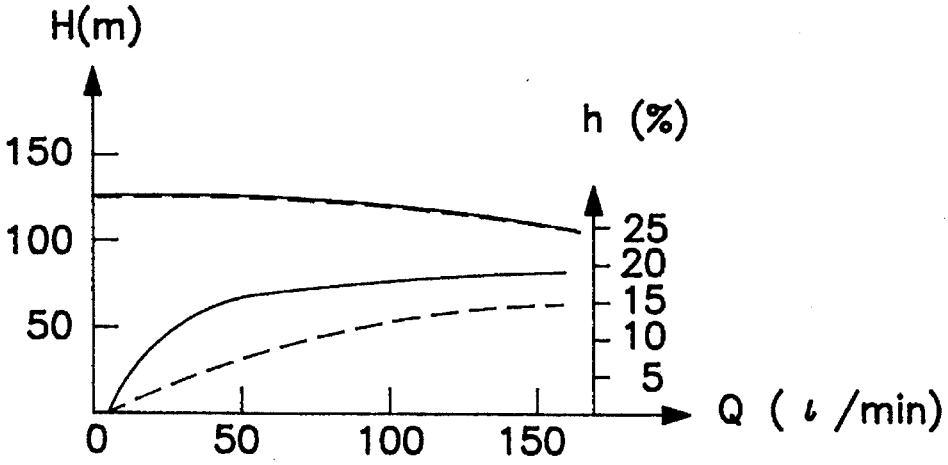
FIG. 20 is a graph of pump efficiencies and pump head properties of the impeller of FIG. 18 and of a conventional solid impeller.

FIG. 20 illustrates the measurement results of the pump performances (Q–H and η) in the low flow rate range of from 0 (l/min) to 150 l/min). The real lines represent the measurement values of the pump performances of the improved solid impeller of the third embodiment. The broken lines represent the measurement values of the pump performances of the conventional solid impeller. The improved solid impeller has almost the same Q–H property as the conventional one, although the pump efficiency of the improved solid impeller is improved compared to the pump efficiency of the conventional solid impeller.

Figure 21:
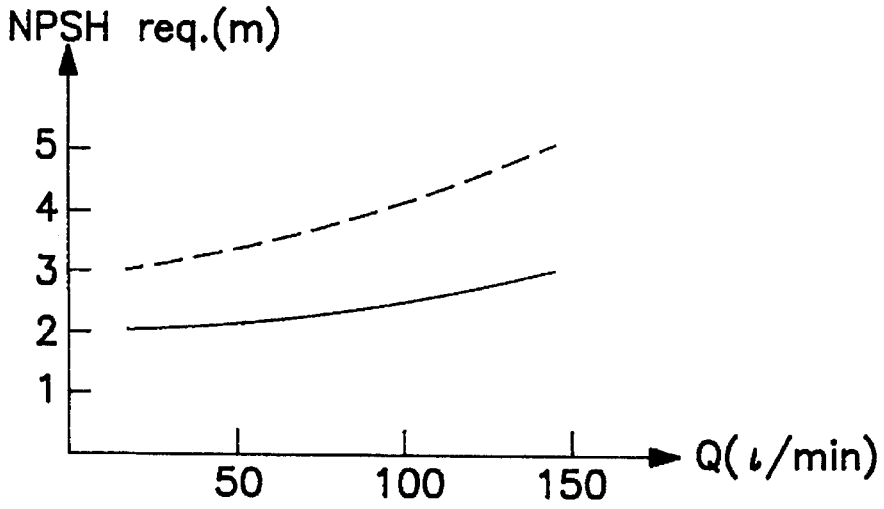
FIG. 21 is a graph of suction properties of the impeller of FIG. 18 and of a conventional solid impeller.

FIG. 21 illustrates the measurement results of the suction properties (NPSHreq) in the low flow rate range of from 0 (l/min) to 150 (l/min). The real line represents the measurement values of the suction properties of the improved solid impeller of the third embodiment, while the broken line represents the measurement values of the suction properties of the conventional solid impeller. The suction property represented by the real line of the improved solid impeller is considerably improved compared to the suction property represented by the broken line of the conventional solid impeller.

Figure 22:
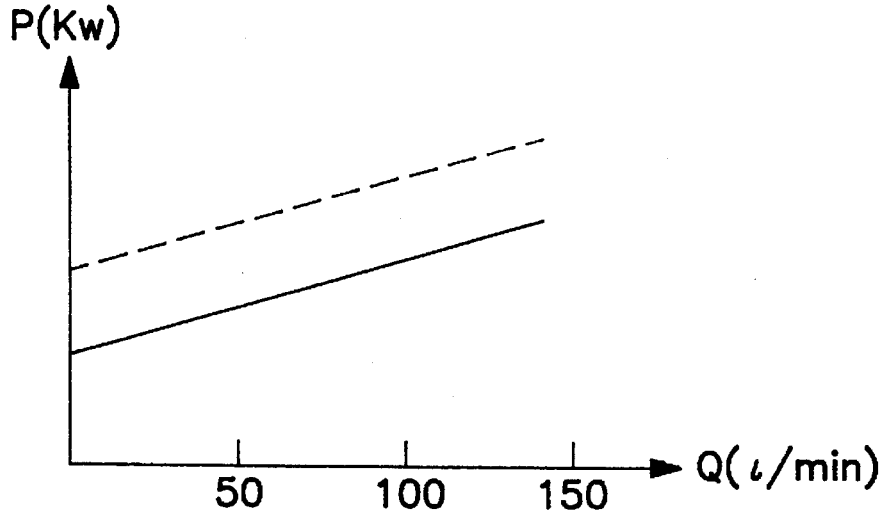
FIG. 22 is a graph of shaft power properties of the impeller of FIG. 18 and of a conventional solid impeller.

FIG. 22 illustrates the measurement results of the shaft power in the low flow rate range of from 0 (l/min) to 150 (l/min). The real line represents the measurement values of the shaft powers of the improved solid impeller of the third embodiment, while the broken line represents the measurement values of the shaft powers of the conventional solid impeller. The shaft power represented by the real line of the improved solid impeller is considerably improved compared to the shaft power represented by the broken line of the conventional solid impeller.

Figure 23:
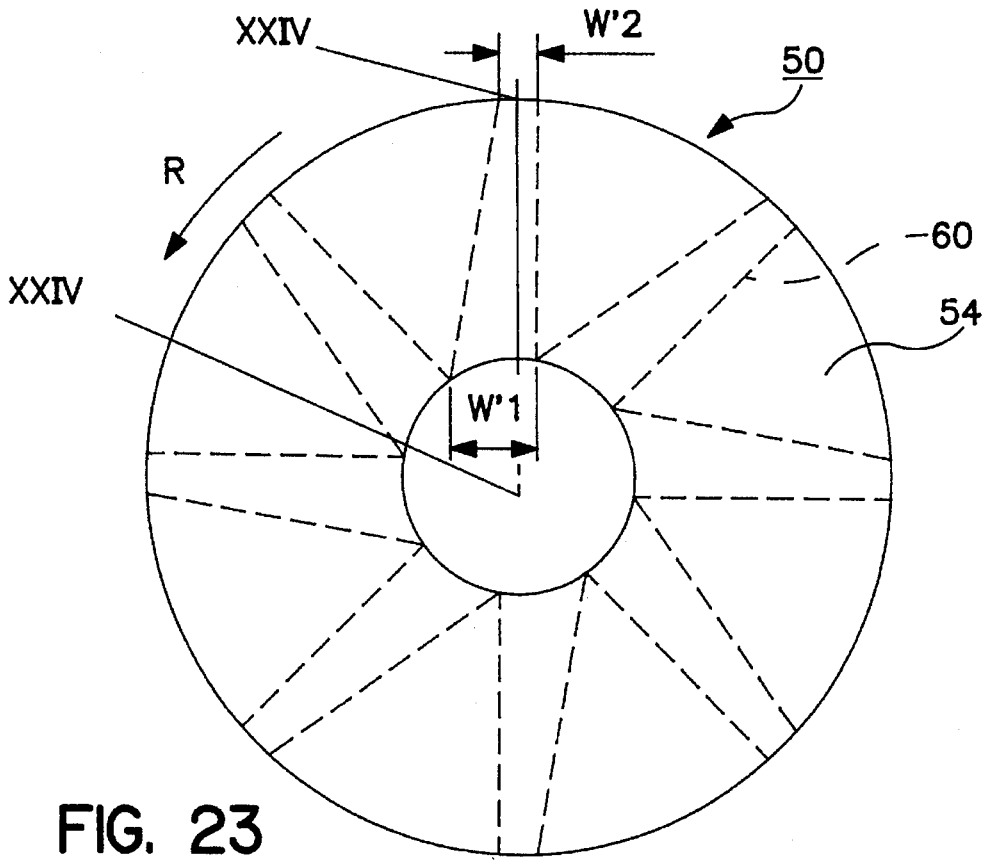
FIG. 23 is a plan view illustrative of a novel solid impeller in a fourth embodiment according to the present invention.
Figure 24:
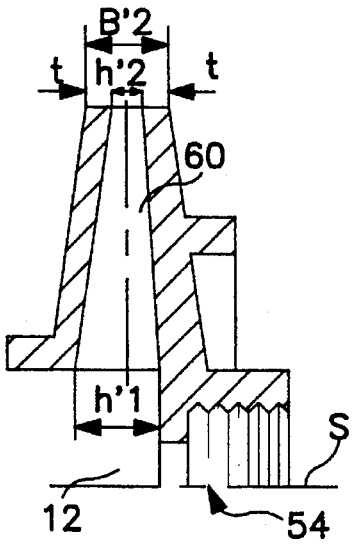
FIG. 24 is a fragmentary cross-sectional elevation view illustrative of the impeller of FIG. 23.

A fourth embodiment according to the present invention will be described with reference to FIGS. 23 and 24 that illustrate a novel structure of the solid impeller. A novel solid impeller 50 of this embodiment according to the present invention has a structural difference in discharge passages 60 involved in the impeller 50. The novel solid impeller 50 comprises a disk-shaped impeller body 54 provided at its center portion with an inlet section 12 extending along an axis X of rotation of the solid impeller 50 and a plurality of discharge passages 60 extending in radial-outward directions. Each of the discharge passages 60 has an inlet port 56 at a boundary to the inlet section and a discharge port 58 at a peripheral region of the disk-shaped impeller body. The inlet port 56 of the discharge passage 60 has an opening verge face parallel to the rotation axis X. The discharge passage has a front side wall at a front side in a rotational direction R of the impeller body 54 and a rear side wall at a rear side in the rotational direction R wherein the front side wall is oblique to a diametrical direction of the disk-shaped impeller body 54. The rear side wall is parallel to the diametrical direction so that at least a longitudinal center axis of the discharge passage is oblique to the diametrical direction and that the horizontal width of the discharge passage is gradually reduced in the outward direction. As a result, each of the discharge passages 60 has a tapered shape in the outward direction. This is so that a section area of the discharge passage 60 is gradually reduced in the outward direction and a thickness B of the disk-shaped impeller body 54 is also gradually reduced in the outward direction. The thickness of the disk-shaped impeller body 54 is proportionately reduced outwardly between the inlet port 56 and the outlet port 58. Similarly, the height h of the individual discharge passage 60 is also proportionately reduced outwardly from $h'_1$ at the inlet port 56 to $h'_2$ at the outlet port 58. Further, as illustrated in FIG. 23, the width W of the individual discharge passage 60 is also proportionately reduced outwardly from $W'_1$ at the inlet port 56 to $W'_2$ at the outlet port 58.

It is preferable that the section sizes of the discharge passage 60 are set so that the width $w'_1$ is the same as the height $h'_1$ as well as the width $w'_2$ is the same as the height $h'_2$. This permits the discharge passage 60 to have the square sectioned shape. It is further preferable that the width $W'_1$ is set at the maximum permissible size of the inlet port 56. Needless to say, the sectioned size or section area of the discharge passage 60 has to be reduced to permit a smooth increase of speed of the treating liquid flowing in the discharge passage 60 without any generation of circulation of the treating liquid.

The disk-shaped impeller body 54 of the improved solid impeller 60 is so defined that the thickness $B'_2$ at the peripheral region of the impeller body 54 is sufficiently smaller than the thickness of the impeller body 54 where the inlet port 56 is provided. This results in a sufficient reduction of area of the peripheral side face of the impeller body 54. Such a reduction of the peripheral side face area of the impeller body 54 may provide a considerable reduction of disk friction loss (Pd). This may result in a considerable improvement in the pump efficiency. As described above, the improved solid impeller 50 has a sufficiently large area of opening vergae of the inlet port 56 of the discharge passage 60. Securing the large area of the opening vergae of the inlet port 56 may ensure a sufficiently high suction property for the solid impeller.

Moreover, the reduction outwardly of the thickness of the disk-shaped impeller body 54 may provide the advantage of a relatively light weight solid impeller thereby resulting in a facilitation of precision casting of the impeller body.

Figure 25:
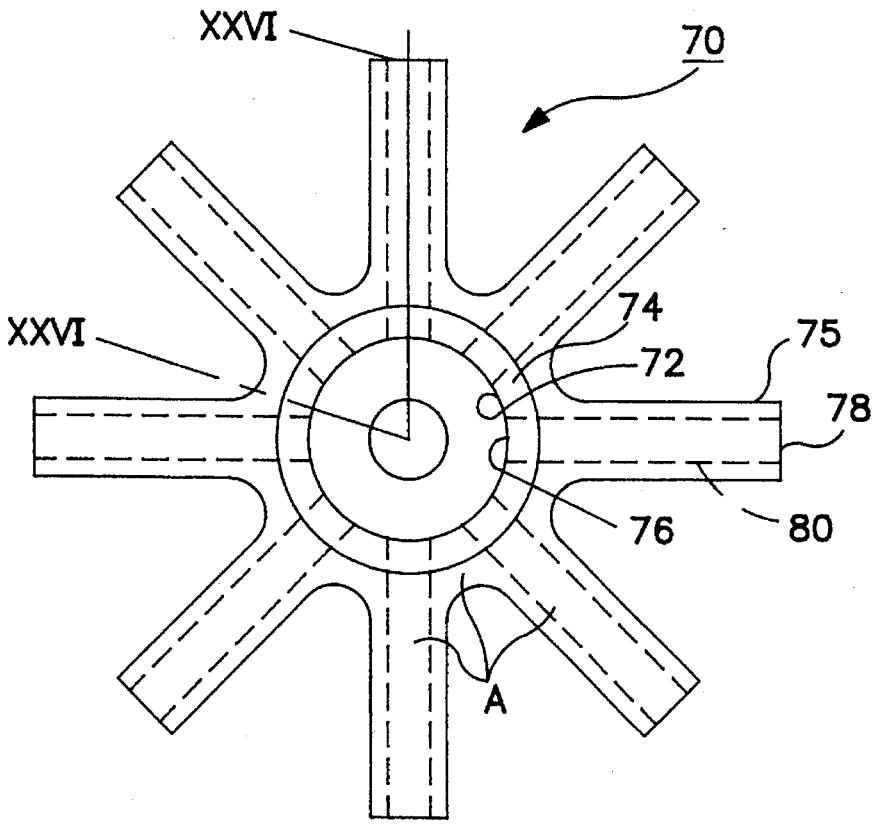
FIG. 25 is a plan view illustrative of a novel solid impeller in a fifth embodiment according to the present invention.
Figure 26:
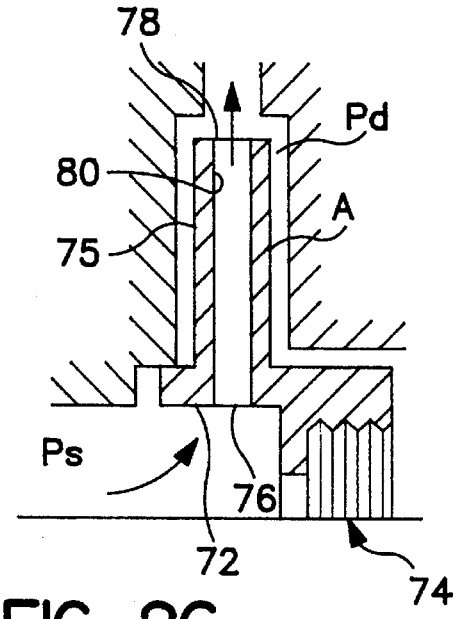
FIG. 26 is a fragmentary cross-sectional elevation view illustrative of the impeller of FIG. 25.

A fifth embodiment according to the present invention will be described with reference to FIGS. 25 and 26 that illustrate a novel structure of the solid impeller. A novel solid impeller 70 comprises a cylindrically-shaped center body 74 and a plurality of arms 75 provided on a peripheral surface of the center body 74 radially extending in an outward direction from the center body 74. Each of the arms 75 includes a discharge passage 80 extending along a longitudinal direction of the arm 75. Any of the flow passages 80 involved in the solid impeller 70 comprise cylindrical passages to prevent a circulation flow loss due to a circulating flow of the treating liquid. Each of the discharge passages 80 has an inlet port 76 at a boundary to an inlet section 72 and a discharge port 78 at a peripheral region of the impeller body 74. The inlet port 76 of the discharge passage 80 has an opening verge face parallel to the rotation axis X. The peripheral section of the impeller 80 comprises the arms 75 including the discharge passages 80 radially extending in the outward direction. This is so that a pressure receiving area A of the impeller 80 is extremely small to thereby facilitate control of the axial thrust and to further prevent leakage losses due to leakage and friction of the impeller as well as suppression of any friction loss.

The improved solid impeller 70 has the quite novel structure to permit a considerable reduction of the pressure receiving area A. This suppresses any generation of the axial thrust defined by T=A (Pd–Ps), for which reason no rear orifice nor balance hole is required. This may provide a simple structure and relatively light weight to the impeller 70. This may permit the improved impeller to be free from the problem of unbalanced axial thrust. It further results in almost no leakage loss. Hence, the improved impeller 70 is free from any bearing trouble. The reliability of the pump operations and pump efficiency is thereby improved.

Moreover, the novel structure of the improved solid impeller 70 has a greatly reduced peripheral side area. This may provide a considerable reduction of disk friction loss, thereby resulting in a considerable improvement in pump efficiency.

From the above, it could be appreciated that although the improved solid impeller has a lateral overhung structure, the improved impeller is free from any bearing trouble and thereby the pump efficiency is improved.

The discharge flow passage 80 comprises a single straight passage to prevent any relative circulation of a treating liquid in the discharge passage 20 thereby resulting in an improvement in the pump efficiency.

Figure 27:
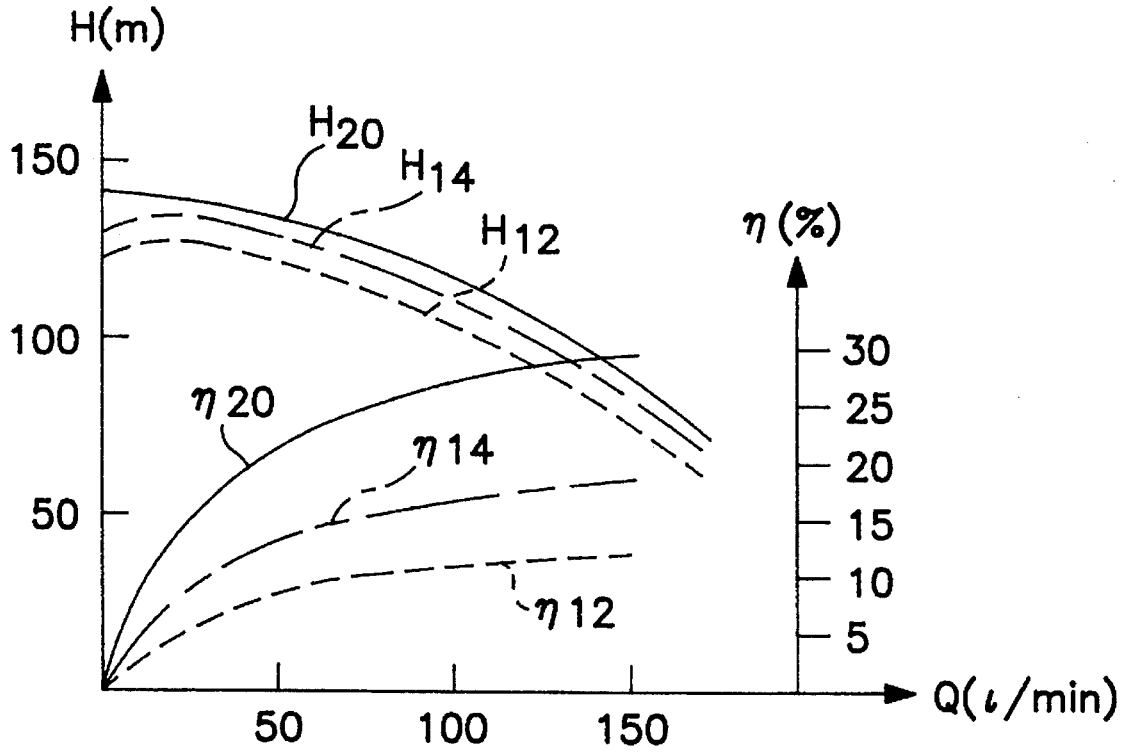
FIG. 27 is a diagram illustrative of pump efficiencies and pump head properties of the impeller of FIG. 25 and of conventional solid and open impellers.

FIG. 27 illustrates the measurement results of the pump performances (Q–H and $\eta$) in the low flow rate range of from 0 (l/min) to 150 (l/min). The real lines $H_{20}$ and $\eta_{20}$ represent the measurement values of the pump performances of the improved solid impeller of the fifth embodiment. The partially broken lines $H_{14}$ and $\eta_{14}$ represent the measurement values of the pump performances of the conventional solid impeller. The broken lines $H_{12}$ and $\eta_{12}$ represent the measurement values of the pump performances of the open impeller. The pump performances represented by the real lines of the improved solid impeller are also considerably improved as compared to the pump performances represented by the broken lines of the conventional solid impeller and the open impeller.

Whereas modifications of the present invention will no doubt be apparent to a person having ordinary skill in the art, to which the invention pertains, it is to be understood that the embodiments shown and described by way of illustrations are by no means intended to be considered in a limiting sense. Accordingly, it is intended to cover by the appended claims any modifications of the invention which fall within the spirit and scope of the invention.

The descriptions therefore focus on the present inventions described above. Consequently, according to the present invention, the inlet port of each of the discharge passages involved in the solid impeller of the present invention has an opening verge face oblique to the rotation axis. The inlet flow of the treating liquid in the inlet section has substantially the same direction as the rotational axis. The opening verge of the inlet port may comprise either a chamfered edge with curvatures or a step-like shaped opening verge. The oblique opening verge face of the inlet port may provide an enlargement of an opening area of the inlet port verge and also may provide either or both a reduction of a fluid inlet angle or of a variation in a flow direction of the treating liquid at the boundary between the inlet section and the inlet port of each of the discharge passages. This results in less reduction of an inflow rate of the treating liquid entering the discharge passage and in a suppression of a contraction effect. This may permit an improvement in an inlet property or an inlet capacity of the inlet port of each of the discharge passages. The improved inlet property or the improved inlet capacity may improve the pump efficiency and may also suppress any cavitation.

According to the present invention, each of the discharge passages has a tapered shape in the outward direction so that a section area of each of the discharge passages is gradually reduced in the outward direction. Further, the disk-shaped impeller body has variable thickness which is gradually reduced in the outward direction. These structures may suppress any relative circulation of the treating liquid in the impeller and also may reduce disk friction loss of the impeller body. The above structures of the impeller may permit variable design choices of sizes of the inlet port of the discharge passage. For example, a variation in an opening verge area of the inlet port may occur by changing an angle of the opening verge face of the inlet port to the rotation axis of the impeller where the flow direction of the treating liquid in the inlet section is parallel to the rotational axis. This may permit a further improvement in the inflow property of the treating liquid entering the discharge passage.

According to the present invention, the impeller comprises a cylindrically-shaped center body and a plurality of arms provided on a peripheral surface of the center body, radially extending in an outward direction from the center body. Each of the arms has a discharge passage extending along a longitudinal direction of the arm so that any flow passages involved in the impeller comprise cylindrical passages. This is to prevent a circulation flow loss due to a circulating flow of the treating liquid. The peripheral section of the impeller comprises arms including discharge passages radially extending in the outward direction so that a pressure receiving area of the impeller is extremely small. This facilitates control of the axial thrust and further prevents leakage losses due to leakage and friction of the impeller suppressing disk friction loss.

What is claimed is:

1. A solid impeller, comprising:

a disk shaped impeller body having a center portion, wherein said impeller body has an inlet section extending along an axis of rotation of said solid impeller; and a plurality of discharge passages extending in radial-outward directions, wherein each of said discharge passages has an inlet port at a boundary to said inlet section and a discharge port at a peripheral region of said impeller body, wherein said inlet port of said discharge passage has an opening verge comprising a chamfered edge with curvatures and a face oblique to said axis of rotation.

2. A solid impeller, comprising:

a disk-shaped impeller body having a center portion, wherein said impeller body has an inlet section extending along an axis of rotation of said solid impeller; and a plurality of discharge passages extending in radial-outward directions, wherein each of said discharge passages has an inlet port at a boundary to said inlet section and a discharge port at a peripheral region of said impeller body, wherein each of said discharge passages has a tapered shape in said outward direction so that a section area and a width of said discharge passage is gradually reduced in said outward direction, and wherein a thickness of said impeller body is gradually reduced in said outward direction, wherein said discharge passage has a front side wall at a front side in a rotational direction of said impeller body and a rear side wall at a rear side in said rotational direction, and wherein said front side wall is oblique to a diametrical direction of said impeller body and said rear side wall is parallel to said diametrical direction so that at least a longitudinal center axis of said discharge passage is oblique to said diametrical direction and that said width of said discharge passage is gradually reduced in said outward direction.

3. A solid impeller comprising:

a disk-shaped impeller body having a center portion, wherein said impeller body has an inlet section extending along an axis of rotation of said impeller; and a plurality of discharge passages extending in radial-outward directions, wherein each of said discharge passages has an inlet port at a boundary to said inlet section and a discharge port at a peripheral region of said impeller body, wherein said inlet port of said discharge passage has an opening verge comprising a step like shaped opening and a face oblique to said axis of rotation.

4. A solid impeller comprising:

a disk-shaped impeller body having a center portion, wherein said impeller body has an inlet section extending along an axis of rotation of said impeller; and a plurality of discharge passages extending in radial-outward directions, wherein each of said discharge passages has an inlet port at a boundary to said inlet section and a discharge port at a peripheral region of said impeller body, wherein said inlet port of said discharge passage has an opening verge having a balance hole and a face oblique to said axis of rotation.

* * * * *